US010253932B2

(12) United States Patent
Rao et al.

(10) Patent No.: US 10,253,932 B2
(45) Date of Patent: Apr. 9, 2019

(54) LIGHTING SYSTEM CONFIGURED TO FIT WITH A BOX OR STRIP HOUSING AND A METHOD OF FITTING A LIGHTING SYSTEM WITH A BOX OR STRIP HOUSING

(71) Applicant: Litetronics International, Inc., Bedford Park, IL (US)

(72) Inventors: Raghu Rao, Romeoville, IL (US); Robert Sorensen, Bedford Park, IL (US)

( * ) Notice: Subject to any disclaimer, the term of this patent is extended or adjusted under 35 U.S.C. 154(b) by 0 days.

(21) Appl. No.: 15/691,320

(22) Filed: Aug. 30, 2017

(65) Prior Publication Data

US 2019/0063692 A1 Feb. 28, 2019

(51) Int. Cl.

| | |
|---|---|
| ***F21S 8/06*** | (2006.01) |
| ***F21V 21/008*** | (2006.01) |
| ***F21K 9/272*** | (2016.01) |
| ***F21V 17/10*** | (2006.01) |
| ***F21V 21/14*** | (2006.01) |
| ***F21K 9/278*** | (2016.01) |
| *F21S 8/04* | (2006.01) |
| *F21Y 115/10* | (2016.01) |
| *F21V 23/06* | (2006.01) |
| *F21Y 103/10* | (2016.01) |

(52) U.S. Cl.

CPC ..... *F21K 9/272* (2016.08); *F21K 9/278* (2016.08); *F21V 17/107* (2013.01); *F21V 21/008* (2013.01); *F21V 21/14* (2013.01); *F21S 8/043* (2013.01); *F21S 8/06* (2013.01); *F21V 23/06* (2013.01); *F21Y 2103/10* (2016.08); *F21Y 2115/10* (2016.08)

(58) Field of Classification Search

CPC ..... F21V 17/107; F21V 21/008; F21S 4/20; F21S 8/043; F21K 9/272

See application file for complete search history.

(56) References Cited

U.S. PATENT DOCUMENTS

| | | | | |
|---|---|---|---|---|
| 8,083,369 | B1 * | 12/2011 | Richardson | F21S 8/026 362/217.11 |
| 9,470,375 | B2 * | 10/2016 | Van Es | F21V 21/005 |
| 9,518,706 | B2 * | 12/2016 | Chan | F21V 15/013 |
| 2014/0198481 | A1 * | 7/2014 | Kim | F21S 8/026 362/95 |

* cited by examiner

*Primary Examiner* — Karabi Guharay

(74) *Attorney, Agent, or Firm* — Steve Witters; Witters & Associates

(57) ABSTRACT

A lighting system configured to fit with a box or strip housing and a method of fitting a lighting system with a box or strip housing are presently disclosed. At least one longitudinally extending light source is held with a light source support. At least two hinges extend from the light source support, proximate a first edge, at least two mounting arms extend from the second side of the light source support, proximate a second edge, wherein the first edge and the second edge of the light source support are parallel.

20 Claims, 5 Drawing Sheets

100
104
103
106
108
102

100
114
110
118
108
112
106
107
CA
119
121
105
117
110
108
116
115
a 108
110
100
110b
110a
107
b
a
108b
108a
102

LIGHTING SYSTEM CONFIGURED TO FIT WITH A BOX OR STRIP HOUSING AND A METHOD OF FITTING A LIGHTING SYSTEM WITH A BOX OR STRIP HOUSING

FIELD OF THE DISCLOSURE

This invention generally relates to lighting systems, and, more particularly, to a lighting system configured to fit with a box or strip housing.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Surface mounted and suspension mounted light fixtures, such as strip fixtures, have typically been installed to provide general lighting of large indoor spaces. For example, surface mount and strip light fixtures may include stem mounted, pendant mounted, and suspension mounted variations as well as those fixtures mounted directly to a ceiling or in the ceiling.

Typically, such strip fixtures include a channel in the form of an inverted box, trough, or troffer, with the channel being attached to, recessed in, or suspended from the ceiling. Lamp holders or sockets are often attached to the channel or troffer. A ballast is often attached within the channel and wiring attaches the ballast to the lamp holders. Power is typically supplied to the ballast by wiring brought into the channel through the top or end of the channel. A ballast cover is often used to cover the ballast and wiring. Linear fluorescent lamps are then typically placed in the lamp holders for operation of the fixture. The lamps may be left bare or covered for providing light to the space below. Because of their low cost and utilitarian use, fluorescent strip light fixtures are installed in abundance. For example, typical uses include warehouses, retail stores, such as grocery, drug, and department stores, where the fixtures are commonly mounted in continuous rows.

Since the introduction of the fluorescent lamp at the 1939 World Fair, fluorescent lighting technology has greatly advanced. For example, over the years, lamp and ballast manufacturers have developed fluorescent lamp-ballast systems with improved efficiencies. More recently, light emitting diode (LED) lamps have been developed. An LED lamp is a solid-state lamp that uses LEDs as the source of light. An LED may comprise a conventional semiconductor light emitting diode or an organic or polymeric light emitting diode. LED lamps may have one or more advantages over fluorescent lamps, for example, LED lamps do not contain mercury, they may turn on more instantaneously, they may have a longer service life, and they may have a greater efficiency.

It may be desired to provide advantages of LEDs to existing fluorescent light fixtures. However, for existing installations, implementation of the newer LED technology may require either replacing the individual fixture components (ballast, lamp holders, wiring, and lamps) or replacing the fixtures all together. Both processes may be time consuming and labor intensive.

Thus, there is a need for a lighting system configured to fit with a box or strip housing.

SUMMARY

In at least one aspect of the present disclosure, a lighting system configured to fit with a box or strip housing is disclosed. The lighting system comprises at least one longitudinally extending light source having a length substantially greater than a width. A light source support holds the at least one longitudinally extending light source on a first side and has a width at least as great as a width of an opening of the box or strip housing being fitted. The light source support and has a length proximate a length of the opening of the box or strip housing being fitted. At least two hinges extend from a second side of the light source support, proximate a first edge of the light source support. At least two mounting arms extend from the second side of the light source support, proximate a second edge of the light source support, wherein the first edge and the second edge of the light source support are parallel.

In at least one other aspect of the present disclosure, each of the at least two hinges and/or each of the mounting arms are adjustable toward or away from the longitudinal axis of the light source support.

In at least one additional aspect of the present disclosure, a method of fitting a lighting system with a box or strip housing is disclosed. The method comprises hanging at least two hinges from a first side of a box or strip housing, each of the hinges extending from a proximate a first edge of a light source support. The light source support holds at least one longitudinally extending light source on a first side, each of the longitudinally extending light sources having a length substantially greater than a width. A driver is electrically connected to a power source. The light source support is then rotated about the hinges and the first edge of the light source support is aligned with a first edge of the box or strip housing and a second edge of the light source support is aligned with a second edge of the box or strip housing. At least two mounting arms are attached to a second side of the box or strip housing, each of the mounting arms extending from proximate a second edge of the light source support.

In at least one further aspect of the present disclosure, a method of fitting a lighting system with a box or strip housing comprises a step of adjusting a distance between the at least two hinges and the at least two mounting arms.

BRIEF DESCRIPTIONS OF THE DRAWINGS

The following figures, which are idealized, are not to scale and are intended to be merely illustrative of aspects of the present disclosure and non-limiting. In the drawings, like elements may be depicted by like reference numerals. The drawings are briefly described as follows.

Figures 1, 2, 3, 4:
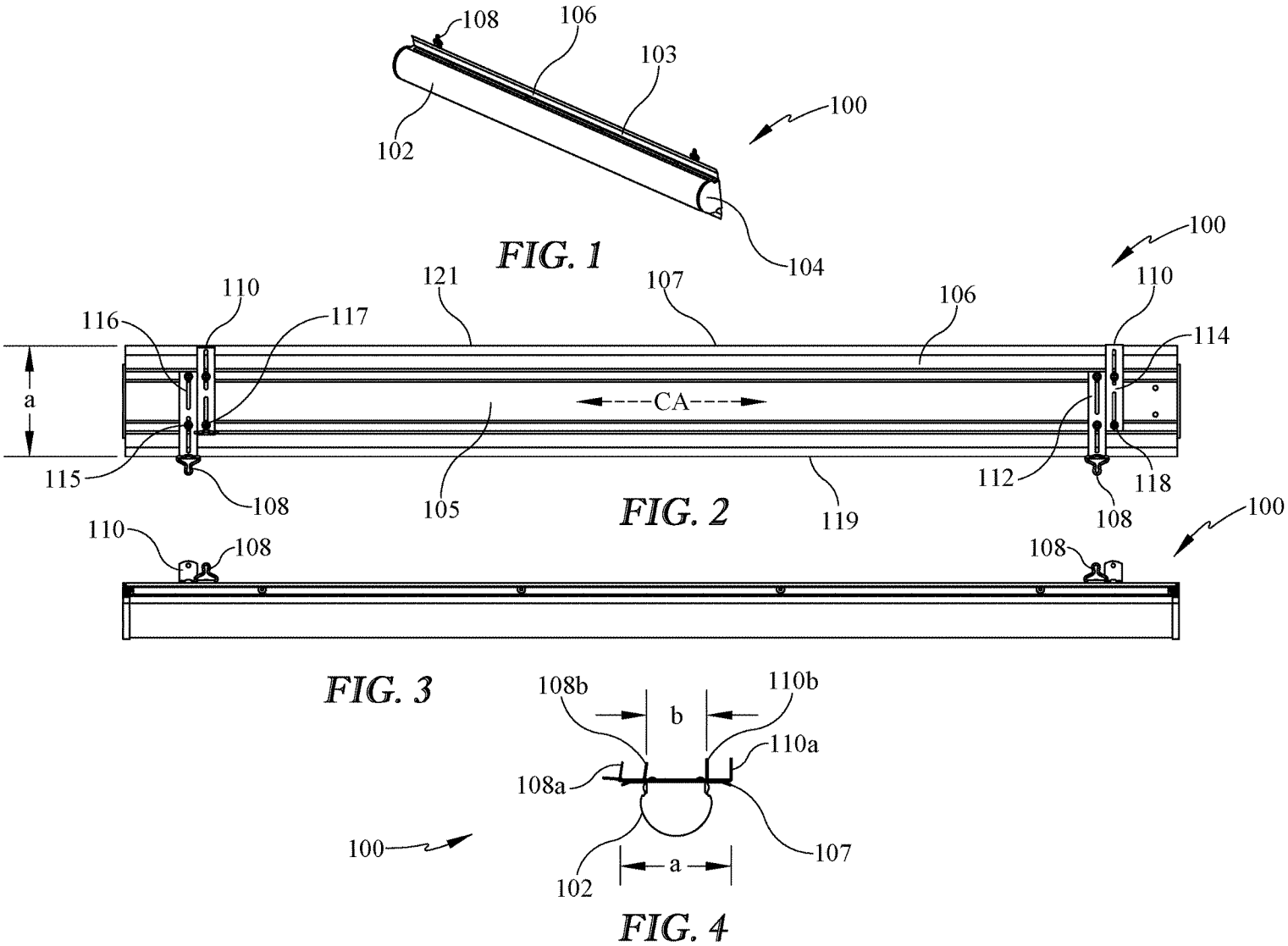
FIG. 1 is a perspective view of a lighting system configured to fit with a box or strip housing.
FIG. 2 is a top view of the lighting system configured to fit with a box or strip housing shown in FIG. 1.
FIG. 3 is a side view of the lighting system configured to fit with a box or strip housing shown in FIG. 1.
FIG. 4 is an end view of the lighting system configured to fit with a box or strip housing shown in FIG. 1.
Figure 7:
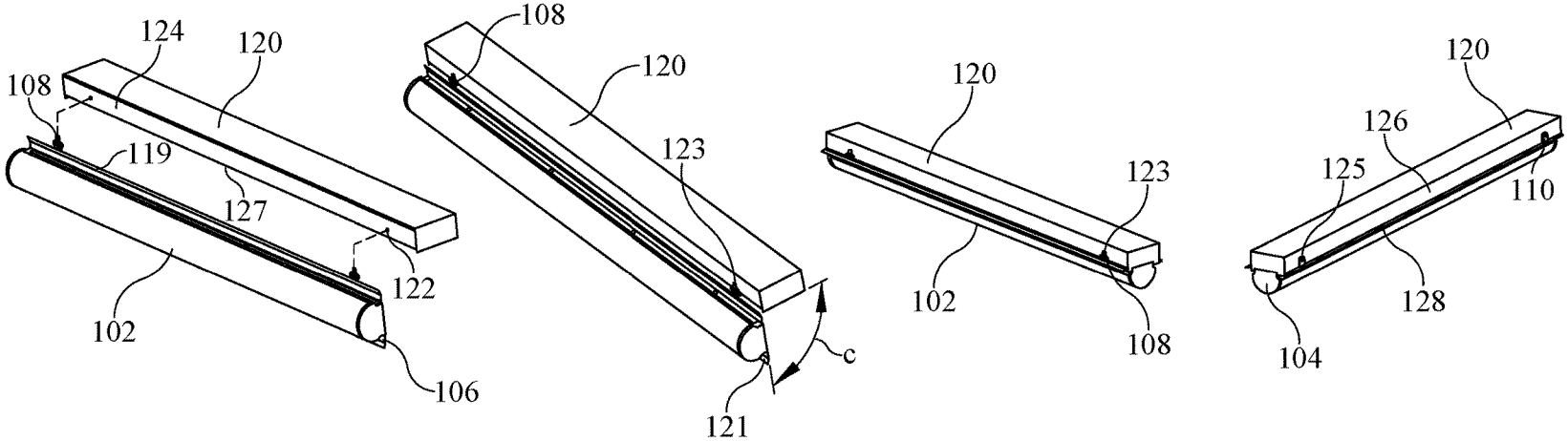
Figure 8:
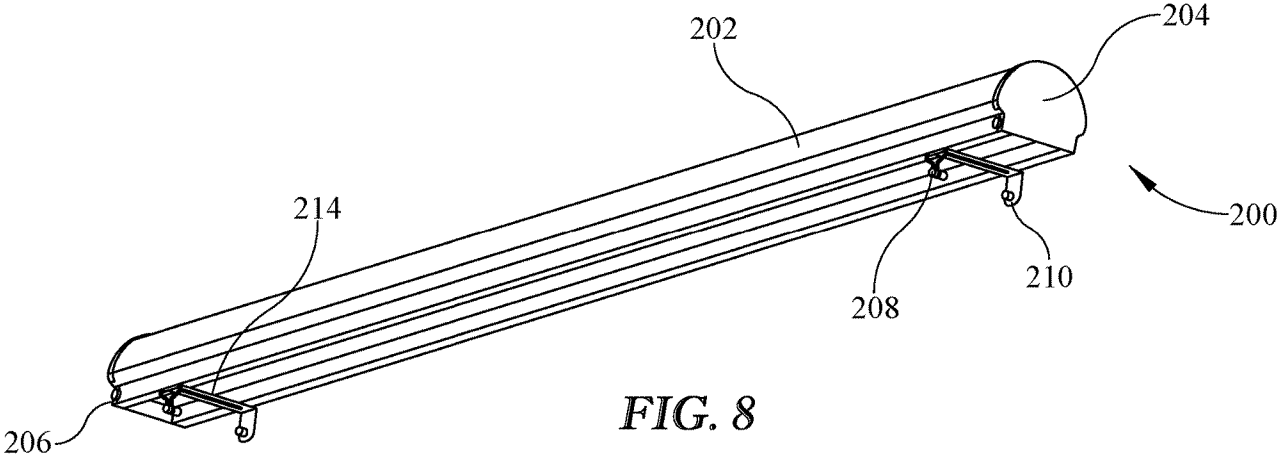
Figure 10:
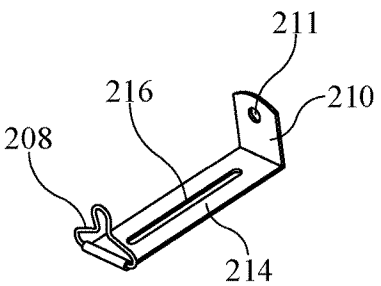
Figure 9:
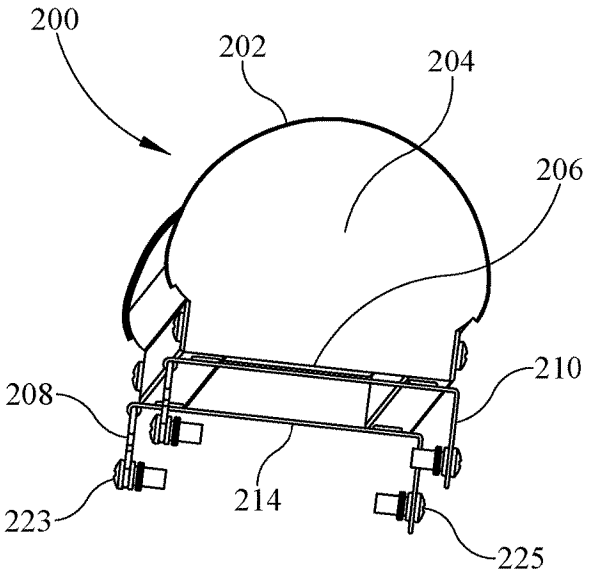
Figure 11:
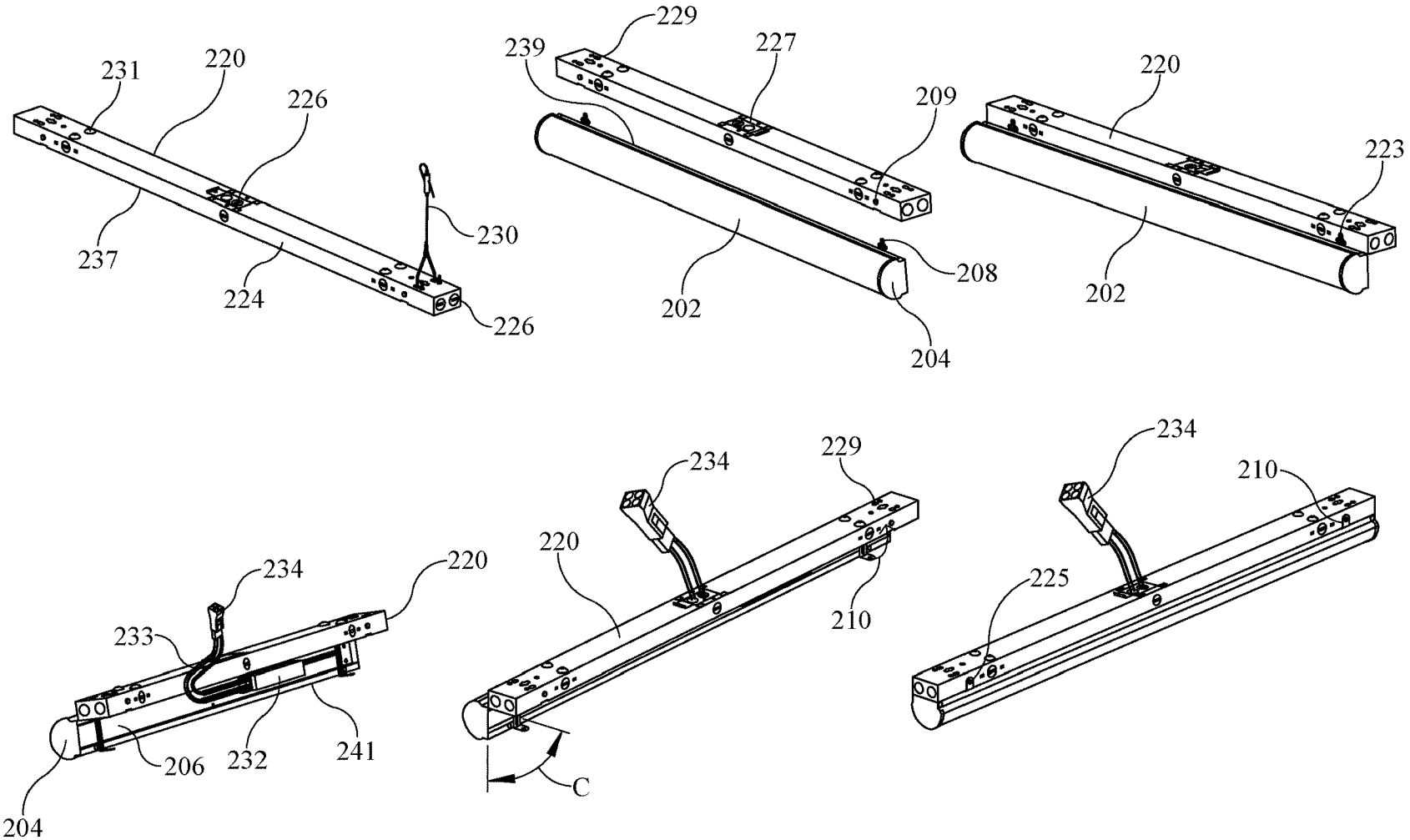
Figure 12:
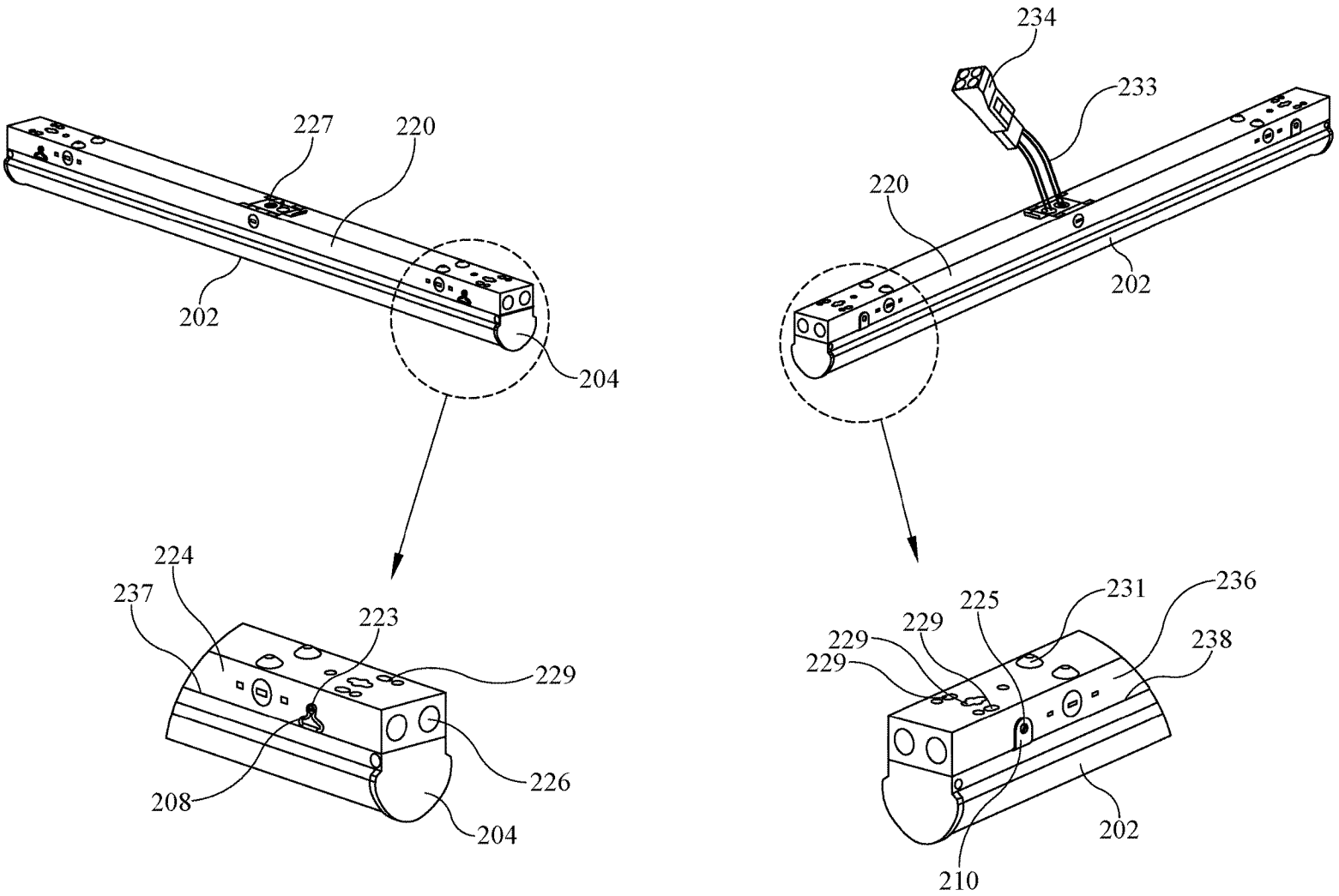

FIG. 7 illustratively shows a method of installing the lighting system shown in FIG. 1 with a box or strip housing;

FIG. 8 is a perspective view of alternative embodiment of a lighting system configured to fit with a box or strip housing;

FIG. 9 is an end perspective view of the lighting system configured to fit with a box or strip housing shown in FIG. 8;

FIG. 10 is a perspective view of a hinge and mounting arm of the present disclosure;

FIG. 11 illustratively shows a method of installing the lighting system shown in FIG. 9 with a box or strip housing; and FIG. 12 shows the lighting system shown in FIG. 8 installed with a box or strip housing.

DETAILED DESCRIPTION

The presently disclosed lighting system configured to fit with a box or strip housing may be adjustable to fit a variety of widths of box or strip housings. For example, a light source support may hold the light source(s) on a first side and may have an adjustable mounting width on a second side. In one illustrative embodiment, the light source support has mounting arms extending from the light support proximate one longitudinal edge and hinges extending proximate the other longitudinal edge. One or both of the hinges and mounting arms may be adjustable toward or away from each other. Adjustment of the hinges and/or mounting arms may provide a variety of mounting widths of the light support for mounting to box or strip housing of various widths. For example, a variety of sizes of existing box or strip housings may be retrofitted with the lighting system of the present disclosure. In at least one embodiment of the present disclosure, the lighting system may have a box or strip housing of a desired width and the light source support may need not have an adjustable mounting width.

The hinges extending from the light source support may provide for ease of installation of the lighting system of the present disclosure. For example, the light source support may be hung proximate its edge from the box or strip housing being fitted and provide access for electrically connecting the light source(s). In at least one aspect of the present disclosure, a driver may be attached to the second side of the light source support. Wiring and a quick connect may extend from the driver which may ease electrical connection of the lighting system to a power source.

Reference will now be made in detail to the present exemplary embodiments and aspects of the present invention, examples of which are illustrated in the accompanying figures. The same reference numbers may be used in the figures to refer to the same or like parts. The presently disclosed embodiments, aspects, and features of the present invention are not to limit the presently claimed invention as other and different embodiments, aspects, and features will become apparent to one skilled in the art upon reading the present disclosure.

FIGS. 1, 2, 3, and 4 respectively show a perspective view, top view, side view, and end view of lighting system 100 configured to fit with a box or strip housing. Lighting system 100 has at least one longitudinally extending light source 102 having a length substantially greater than a width. For example, light source 102 may have a length of about 2 to about 6, 8, or 10 feet, or longer or shorter in about one inch increments. In at least one embodiment, light source 102 has length of about 4 feet. The width of light source 102 may be less than about 2 inches, for example light source 102 may have a width of about 1 and a quarter inch, or wider or narrower. In at least one embodiment of the present disclosure, light source 102 has LEDs.

Light source support 106 has a width at least as great as a width of an opening of the box or strip housing being fitted, for example, box or strip housing 120, shown in FIG. 7, or box or strip housing 220, shown in FIG. 11. Light source support 106 holds at least one longitudinally extending light source 102 on a first side 103 and has a length proximate a length of the opening of the box or strip housing being fitted. At least two hinges 108 extend from a second side 105 of the light source support, proximate a first edge 119. At least two mounting arms 110 extend from the second side of light source support 106, proximate a second edge 121. First edge 119 and second edge 121 of light source support 106 are parallel.

Light source support 106 may have an adjustable mounting width for mounting to different boxes or strip housings. For example, mounting arms 110 and/or hinges 108 may be adjustable.

Figure 6:
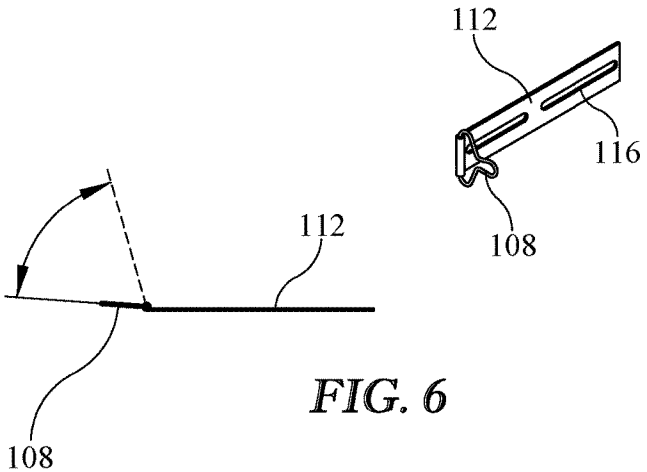
FIG. 6 shows a perspective and side view of a hinge of the present disclosure.

Each of the at least two hinges may be adjustable toward or away from first edge 119 of light source support 106. For example, each hinge 108 may extend from a leg 112 with a slot 116, as shown in FIG. 6. Slot 116 may be configured and disposed to cooperate with a fastener, for example fastener 118 shown in FIG. 2, extending from the second side of light source support 106. Leg 112, slot 116, and fastener 118 may be configured and disposed for adjusting a distance between hinges 108 and mounting arms 110.

Figure 5:
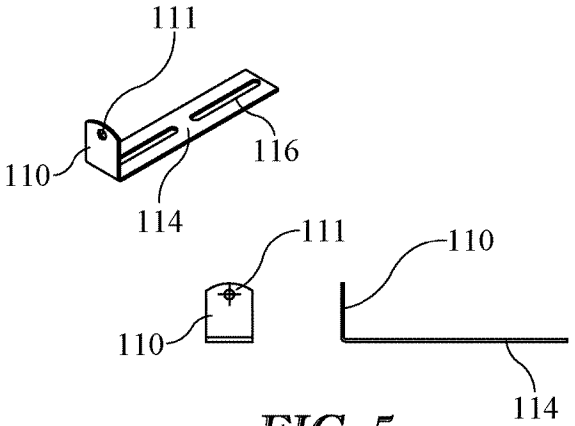
FIG. 5 shows a perspective, end, and side view of a mounting arm of the present disclosure.

Each mounting arm 110 may be adjustable toward or away from second edge 121 of light source support 106. For example, each mounting arm 110 may extend from a leg 114 with a slot 116, as shown in FIG. 5. Slot 116 may be configured and disposed to cooperate with a fastener, for example fastener 118, extending from the second side of light source support 106. Leg 112, slot 116, and fastener 118 may be configured and disposed for adjusting a distance between hinges 108 and mounting arms 110.

Both of hinges 108 and mounting arms 110 may be adjustable toward or away from each other. In at least one embodiment, light source support 106 comprises a first fastener opening 115 and a second fastener opening 117. First fastener opening 115 and second fastener opening 117 may be longitudinally offset on light source support 106. This may configure leg 114 of mounting arm 110 and leg 112 of hinge 108 to both become disposed across a center longitudinal axis CA of light source support 106.

Light source support 106 may have a width greater than a width of the box or strip housing being fitted. For example, as shown in FIG. 7, light source support 106 has edge portions 107 extending beyond the sides of box or strip housing 120. This configuration may permit light source 106 to cover or hide the opening in a variety of sizes of box or strip housings 120. Edge portions 107 may curve outwardly or extend toward longitudinally extending light source 102.

Light source 102 may have translucent ends, or end caps, 104. Ends 104 may be configured to be illuminated with the illumination of longitudinally extending light source 102. Lighting system 100 may have box or strip housing 120 configured for holding the light source support and for surface or suspension mounting of lighting system 100. In at least one embodiment, light source support 106 has an adjustable mounting width configuring lighting system 100 to be retrofitted with existing box or strip housings of various widths and lighting system 100 need not have box or strip housing 120.

For example, as shown in FIGS. 2 and 4, hinges 108 and mounting arms 110 may be adjusted outwardly to positions 108*a* and 110*a* and have a distance "a" therebetween. Hinges 108 and mounting arms 110 may be adjusted inwardly to positions 108*b* and 110*b* and have a distance "b" therebetween. These mounting distances, "a" and "b", may be adjusted for fitting light source support 106 with different size boxes or strip housings. It is to be understood that hinges 108 and mounting arms 110 may be adjusted to have any desired mounting distance therebetween.

Box or strip housing 120 may have at least one knock out or opening 226 configured for electrically connecting the least one longitudinally extending light source 102 with a power source.

FIG. 5 shows a perspective, end, and side view of a mounting arm 110 of the present disclosure. Mounting arm 110 may extend from leg 114 which may have a slot 116. Slot 116 may be configured and disposed to cooperate with a fastener 118 extending from second side 105 of light source support 106. Leg 114, slot 116, and fastener 118 may be configured and disposed for adjusting a distance between mounting arm 110 and central longitudinal axis CA of light source support 106. Mounting arm 110 may have an aperture 111 configured and disposed to receive a fastener for fastening to box or strip housing 120.

FIG. 6 shows a perspective and side view of hinge 108 of the present disclosure. Hinge 108 may have a triangular configuration. Hinge 108 may extend from leg 112 which may have a slot 116. Slot 116 may be configured and disposed to cooperate with a fastener 118 extending from second side 105 of light source support 106. Leg 112, slot 116, and fastener 118 may be configured and disposed for adjusting a distance between hinge 108 and central longitudinal axis CA of light source support 106.

FIG. 7 illustratively shows a method of installing lighting system 100 with a box or strip housing 120. Lighting system 100 may be hung by at least two hinges 108 from a first side 124 of box or strip housing 120. Each hinge 108 may extend from a proximate a first edge 119 of light source support 106. Light source support 106 may hold at least one longitudinally extending light source 102 on a first side 103, each longitudinally extending light source has a length substantially greater than a width. Upon hanging light support 106 from a first side 124 of box or strip housing 120, a driver, such as driver 232 shown in FIG. 11, may be electrically connected to a power source.

Light source support 106 may be rotated about hinges 108 and first edge 119 of light source support 106 may be aligned with first edge 127 of box or strip housing 120 and second edge 121 of light source support 106 may be aligned with second edge 128 of box or strip housing 120. Mounting arm fasteners 125 may be extended through apertures 111 in mounting arms 110 and fastened to second side 126 of box or strip housing 120. Mounting arms 110 may extend from proximate second edge 128 of light source support 106. The method may comprise a step of adjusting a distance between hinges 108 and mounting arms 110 for fitting with box or strip housings 120 of various widths.

FIGS. 8 and 9 respectively show a side perspective view and an end perspective view of lighting system 200 configured to fit with box or strip housing 220, shown in FIG. 11. Lighting system 200 has at least one longitudinally extending light source 202 having a length substantially greater than a width. Light source support 206 has a width at least as great as, or substantially equivalent to, a width between parallel sides of box or strip housing 220 being fitted. Light source support 206 holds at least one longitudinally extending light source 202 on a first side.

At least two hinges 208 and at least two mounting arms 210 extend from parallel longitudinal edges of a second side of light source support 206. Fasteners 225 may be configured for attaching mounting arms 210 to one longitudinal side of box or strip housing 220 and fasteners 223 may be configured for attaching hinges 208 to the parallel longitudinal side of box or strip housing 220, as shown in FIGS. 11 and 12.

FIG. 10 shows a perspective view of a hinge and mounting arm assembly of the present disclosure. Each mounting arm 210 and each hinge 208 may extend from ends of a common leg 214. Leg 214 may be configured to be attached to the second side of light source support 206. For example, leg 214 may have a slot 26, or other opening, configured for receiving a fastener for fastening to light source support 206. Other and different means for fastening leg 214 to light source support 206 as are known by persons having ordinary skill in the art may be used to fasten leg 214 to light source support 206.

Mounting arm 210 may have aperture 211 configured to receive fastener 225 for fastening to the longitudinal side of box or strip housing 220. Hinges 208 may be triangular and may have an extending end portion for receiving fasteners 223. Leg 214 may extend between mounting arm 210 and hinge 208 and may have a length for mounting the mounting arms and the hinges to outer parallel longitudinal surfaces of box or strip housing 220.

Light source 202 may have translucent ends, or end caps, 204. Ends 204 may be configured to be illuminated with the illumination of longitudinally extending light source 202.

Lighting system 200 may have box or strip housing 220 configured for holding light source support 206 and for surface or suspension mounting of lighting system 200. For example, as shown in FIG. 11, box or strip housing 220 may have suspension mounts 230 extending from proximate each end of box or strip housing 220. Box or strip housing 220 may have surface mounting apertures 229 and optionally protuberances 231, which may enable box or strip housing 220 to be mounted to a surface.

FIG. 11 illustratively shows a method of installing the lighting system 200 with box or strip housing 220 and FIG. 12 shows light source support 206 mounted with strip housing 220. Box or strip housing 220 may be suspension or surface mounted. Light source support 206 may be hung by at least two hinges 208 from a first side 224 of box or strip housing 220. For example, hinge fasteners 223 may be extended through hinge 208 and attached at fastener location 209 in first side 224 of box or strip housing 220. Each hinge 208 may extend from a proximate a first edge 239 of light source support 206.

Light source support 206 may hold at least one longitudinally extending light source 202 on a first side. Each longitudinally extending light source 202 has a length substantially greater than a width. Light source support 206 may have a driver 232 mounted to the second side thereof and a quick connect 234 in electrical communication with driver 232. Quick connect 234 may be configured to extend through knock out or opening 226 in the box or strip housing 220. Quick connect 234 may be in electrical communication with light source 202 with electrical communicators 233, which may be wires. Quick connect 234 may ease electrically connecting longitudinally extending light source 202 with a power source. In at least one embodiment, box or strip housing 220 has a mounting plate 227 configured for mounting lighting system 200 to a junction box.

Upon hanging light support 206 from a first side 224 of box or strip housing 220, driver 232 may be electrically connected to a power source. Driver 232 may be mounted on the second side of light source support 206. Wires or electrical communicators 233 may extend from driver 232 and may have quick connect 234 on an end thereof. Quick connect 234 may be configured and disposed to provide ease in electrically connecting driver 232 to an external power source. For example, quick connect 234 may be extended through knock out or opening 226 and connected to a power source.

Light source support 206 may be rotated about hinges 208 and first edge 239 of light source support 206 may be aligned with first edge 237 of box or strip housing 220 and second edge 241 of light source support 206 may be aligned with second edge 238 of box or strip housing 220. Mounting arm fasteners 225 may be extended through apertures 211 in mounting arms 210 and fastened to second side 236 of box or strip housing 220. Mounting arms 210 may extend from proximate second edge 238 of light source support 206.

NOMENCLATURE lighting system 100
longitudinally extending light source 102
first side of light source support 103
light source end 104
second side of light source support 105
light source support 106
longitudinal edge portion of light source support 107
hinge 108
first positioning of hinge 108*a*
second positioning of hinge 108*b*
mounting arm 110
first positioning of mounting arm 110*a*
second positioning of mounting arm 110*b*
aperture 111
hinge leg 112
mounting arm leg 114
first fastener position 115
slot 116
second fastener position 117
leg fastener 118
first edge of the light source support
box or strip housing 120
second edge of the light source support 121
fastener location 122
hinge fastener 123
first side of box or strip housing 124
mounting arm fastener 125
second side of box or strip housing 126
first edge of box or strip housing 127
second edge of box or strip housing 128
lighting system 200
longitudinally extending light source 202
light source end 204
light source support 206
hinge 208
fastener location in first side of box or strip housing 209
mounting arm 210
aperture 211
mounting leg 214
slot 216
box or strip housing 220
hinge fastener 223
first side of box or strip housing 224
mounting arm fastener 225
knock out or opening 226
mounting plate 227
surface mounting aperture 229
suspension mount 230
protuberance 231
driver 232
electrical communicators 233
quick connect 234
second side of box or strip housing 236
first edge of box or strip housing 237
second edge of box or strip housing 238
first edge of the light source support 239
second edge of the light source support 241
first distance between hinge and mounting arm a
second distance between hinge and mounting arm b
rotation of the light source support about the hinges c
central longitudinal axis of light source support CA

The invention claimed is:

1. A lighting system configured to fit with a box or strip housing having a top wall, two parallel longitudinally extending sidewalls extending from the top wall, and two parallel end walls extending from the top wall and the sidewalls, forming a bottom opening, wherein the width of bottom opening is defined by the end walls and the length of the bottom opening is defined by the sidewalls, the lighting system comprising:

at least one longitudinally extending light source having a length substantially greater than a width;

a light source support having a width at least as great as the width of the bottom opening of the box or strip housing being fitted;

the light source support holds the at least one longitudinally extending light source on a first side and has a length proximate the length of the bottom opening of the box or strip housing being fitted;

at least two hinges extending from a second side of the light source support, proximate a first edge of the light source support and configured and disposed to cooperate with one of the two parallel longitudinally extending sidewalls; and at least two mounting arms extending from the second side of the light source support, proximate a second edge of the light source support and configured and disposed to cooperate with the other of the two parallel longitudinally extending sidewalls, wherein the first edge and the second edge of the light source support are parallel.

2. The lighting system of claim 1, wherein each of the at least two hinges are adjustable toward or away from the first edge of the light source support, the lighting system being configured for adjusting a mounting width, between the at least two hinges and the at least two mounting arms of the light support, for mounting to the box or strip housing having various widths.

3. The lighting system of claim 2, wherein each of the at least two adjustable hinges extend from a leg with a slot configured and disposed to cooperate with a fastener extending from the second side of the light source support, the leg, slot, and fastener being configured and disposed for adjusting a distance between the hinges and the mounting arms.

4. The lighting system of claim 1, wherein each of the at least two mounting arms are adjustable toward or away from the second edge of the light source support, the lighting system being configured for adjusting a mounting width, between the at least two hinges and the at least two mounting arms of the light support, for mounting to the box or strip housing having various widths.

5. The lighting system of claim 4, wherein each of the at least two adjustable mounting arms extend from a leg with a slot configured and disposed to cooperate with a fastener extending from the second side of the light source support, the leg, slot, and fastener being configured and disposed for adjusting a distance between the mounting arms and the hinges, and wherein each of the at least two hinges are adjustable toward or away from the first edge of the light source support, each of the at least two adjustable hinges extend from a leg with a slot configured and disposed to cooperate with a fastener extending from the second side of the light source support, the leg, slot, and fastener being configured and disposed for adjusting a distance between the hinges and the mounting arms.

6. The lighting system of claim 5, wherein the light source support comprises a first fastener opening and a second fastener opening, the first fastener opening and the second fastener opening being longitudinally offset on the light source support and configuring the leg of the mounting arm and the leg of the hinge to both be disposed across a center longitudinal axis of the light source support.

7. The lighting system of claim 1, wherein each of the at least two hinges have a triangular shape.

8. The lighting system of claim 1 further comprising a driver mounted to the second side of the light source support.

9. The lighting system of claim 8 further comprising a quick connect in electrical communication with the driver, the quick connect being configured to connect the lighting system to a power source.

10. The lighting system of claim 1, wherein the light source support has a width greater than a width of the box or strip housing being fitted.

11. The lighting system of claim 10, wherein the light source support has longitudinal edge portions extending toward the at least one longitudinally extending light source.

12. The lighting system of claim 1, wherein the light source support has a width approximately equivalent to a width of the box or strip housing being fitted.

13. The lighting system of claim 1, wherein the light source has translucent ends configured to be illuminated with the illumination of the at least one longitudinally extending light source.

14. The lighting system of claim 1 further comprising box or strip housing configured for holding the light source support and for surface or suspension mounting of the lighting system.

15. The lighting system of claim 14, wherein the box or strip housing has at least one knock out or opening configured for electrically connecting the least one longitudinally extending light source with a power source.

16. The lighting system of claim 15 further comprising a driver mounted to the second side of the light source support and a quick connect in electrical communication with the driver, the quick connect being configured to extend through the at least one knock out or opening in the box or strip housing and electrically connecting the least one longitudinally extending light source with a power source.

17. The lighting system of claim 14, wherein each of the mounting arms and each of the hinges extend from a leg attached to the second side of the light source support.

18. The lighting system of claim 17, wherein the leg extending between the mounting arm and the hinge has length for mounting the mounting arms and the hinges to outer parallel longitudinal surfaces of the box or strip housing.

19. A method of fitting the lighting system of claim 1 with the box or strip housing, the method comprising the steps of:

hanging the at least two hinges from a first side of the box or strip housing;

electrically connecting a driver to a power source;

rotating the light source support about the hinges and aligning the first edge of the light source support with a first edge of the box or strip housing and aligning the second edge of the light source support with a second edge of the box or strip housing; and attaching the at least two mounting arms to a second side of the box or strip housing.

20. The method of claim 19 further comprising a step of adjusting a distance between the at least two hinges and the at least two mounting arms.

* * * * *